US005816557A

United States Patent [19]

Tepper

[11] Patent Number: 5,816,557

[45] Date of Patent: Oct. 6, 1998

[54] OBJECT HANGER BRACKET FOR OMNI PLACEMENT ON DRY-WALL

[76] Inventor: John E. Tepper, 1842 Gardener Rd., Eagle Point, Oreg. 97524

[21] Appl. No.: 686,596

[22] Filed: Jul. 26, 1996

[51] Int. Cl.[6] ..... A47G 1/16

[52] U.S. Cl. ..... 248/495; 248/476; 248/490; 248/497

[58] Field of Search ..... 248/495, 473, 248/476, 478, 493, 490, 497, 498, 305, 306, 222.11

[56] References Cited

U.S. PATENT DOCUMENTS

| | | | |
|---|---|---|---|
| 145,825 | 12/1873 | Wright | 248/495 X |
| 1,107,686 | 8/1914 | Mehrmann | 248/495 |
| 1,908,200 | 5/1933 | Webster | 248/495 |
| 2,503,123 | 4/1950 | Morlan | 248/305 |
| 2,583,563 | 1/1952 | Habel | 248/305 X |
| 2,952,431 | 9/1960 | Pedley | 248/495 |
| 3,138,359 | 6/1964 | Stewart | 248/495 |
| 3,224,721 | 12/1965 | Malmquist | 248/305 X |
| 3,265,339 | 8/1966 | Hushek | 248/495 X |
| 3,352,527 | 11/1967 | Merett | 248/495 X |
| 4,645,165 | 2/1987 | Raap | 248/495 X |
| 4,821,992 | 4/1989 | Johnson | 248/497 X |
| 5,069,411 | 12/1991 | Murphy | 248/476 |
| 5,314,159 | 5/1994 | Szarata | 248/476 |
| 5,342,014 | 8/1994 | Wilson | 248/476 |

FOREIGN PATENT DOCUMENTS

| | | | |
|---|---|---|---|
| 470274 | 8/1937 | United Kingdom | 248/495 |

*Primary Examiner*—William Stryjewski
*Attorney, Agent, or Firm*—William H. Maxwell

[57] ABSTRACT

A bracket for omni placement of heavy objects at the planar face of a wall by cantilevering the hanging center from the next adjacent underlying stud, especially adapted to dry-wall construction, and characterized by a mounting secured by spaced top and bottom fasteners, a cantilever arm to fixed to the mounting to extend right or left against the wall, and a hanger slide selectively positioned along the arm to receive a support wire or hook for suspension of the object.

14 Claims, 2 Drawing Sheets

OBJECT HANGER BRACKET FOR OMNI PLACEMENT ON DRY-WALL

BACKGROUND OF THE INVENTION

This invention relates to the hanging of heavy pictures and the like on dry-wall construction. The stronger lath-and-plaster wall construction has been replaced almost entirely by the weaker dry-wall construction in the building of dwellings and commercial establishments, employing gypsum board. And, regardless of the thickness and quality of the dry-wall gypsum board there is a prevalent propensity for mechanical failure, due to the soft chalky core that is low in its physical properties. That is, dry-wall panels are easily crushed and sheared and do not withstand great loads such as those imposed when applying or hanging a heavy object thereto. Furthermore, the paper surface which characterizes dry-wall panels is a mechanically and/or structurally inferior material, and it too does not sustain great loads. Consequently, heavy objects such as mirrors and large pictures and the like cannot be safely hung from the surface of dry-wall panels, regardless of their thickness and/or quality; unless the hanging device is fastened into the wall framing or studs. However, the studs of the wall are most often not in the appropriate position to hang the object or picture, and the available dry-wall placement is obviously structurally weak and unsafe for the hanging. Therefore, it is an object of this invention to provide a structurally efficient and safe hanger bracket for omni placement on dry-wall construction.

Typical wood frame building construction is comprised of top and bottom horizontal plates separated by vertical studs spaced on 16 inch centers. The basic wooden stud cross section is 2×4 inches, which to this day's standards is reduced to 1½×3½ inches; this being the major body of wood material to which the dry-wall panels are fastened and to which soffits and shelving and the like are fastened. Or for example, a heavy object such as a large mirror is to be hung, the location of which is always an important factor. And, in order to hang an object such as a large picture or heavy mirror, it is imperative that it be balanced on it's center so as to depend vertically, this center position being the controlling factor and which is not likely to coincide with the arbitrary 16 inch O.C. position of a wall supporting stud. Accordingly, it is an object of this invention to cantilever the hanger support for a heavy object, so that it's weight at the selected placement at the plane of the wall will be carried by a next adjacent stud.

It is another object of this invention to provide a structural bracket at the exterior plane of a wall, especially a dry-wall, whereby support for the load of an object is transferred from a selected intermediate position between studs to the next adjacent stud.

It is still another object of this invention to provide for selection of right hand and left hand cantilevered positioning of said load, to thereby select the nearest stud for support.

And, it is an object of this invention to provide a catch to prevent accidental displacement of a supporting wire or hook that carries the picture or object being hung.

SUMMARY OF THE INVENTION

Further, it is an object of this invention to provide an assembly of the fewest number of simple and most effective parts, whereby a safe and effective object hanger is made possible. In practice, there is a bracket comprised of a first mounting leg secured to the vertical supporting stud by deep penetrating widely spaced high shear fasteners. There is a second horizontal cantilever support arm selectively installed to extend left or right and disposed contiguously against the planar surface of the wall to which the assembly is attached by the afrementioned screw fasteners. And there is a third slide member in the form of a retainer or hook that is adjustably positioned along the support arm where it rests in position by frictinal engagement; finely adjusted as circumstances require. The back sides of said first and second members are faced with double sided pressure sensitive adhesive tape, for empirical placement prior to applying the screw fasteners.

The foregoing and various other objects and features of this invention will be apparent and fully understood from the following detailed description of the typical preferred forms and applications thereof, throughout which description reference is made to the accompanying drawings.

THE DRAWINGS

Figure 7:
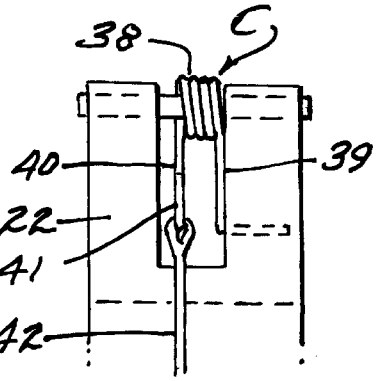

And, FIG. 7 is an enlarged fragmentary front view of the releasable catch that prevents displacement of a suspension wire or hook.

PREFERRED EMBODIMENT

Referring now to the drawings, the Hanger Bracket is a cantilever support that is disposed to be essentially coplanar with a dry-wall or the like to carry heavy objects which are not necessarily in alignment with an underlying stud of the wall structure. This Hanger Bracket is comprised generally of three members, a hanger mounting M1 (M2), a cantilever arm A, and a hanger slide S. These members are preferably aluminum extrusions, there being a basic extrusion adapted to be formed into several embodiments of the hanger mounting M1 and M2, and a common extrusion to form the cantilever arm A. A feature of this Hanger Bracket is it's adaptability to right or left extension of the hanging center that is omni adjustable as circumstances require.

Figure 1:
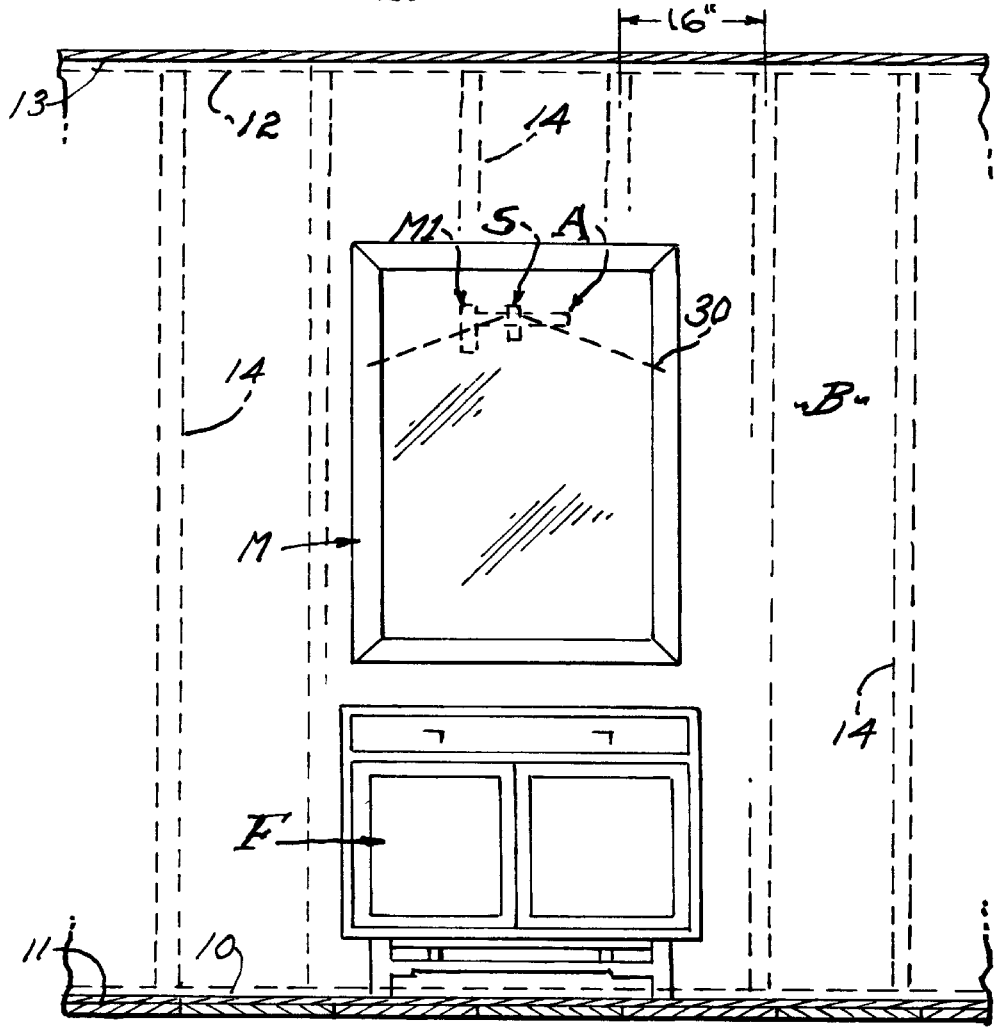
FIG. 1 is a front elevation view of a typical dry-wall construction illustrating the hanging of a heavy mirror over a piece of furniture and showing the application of the Hanger Bracket of the present invention.
Figure 2:
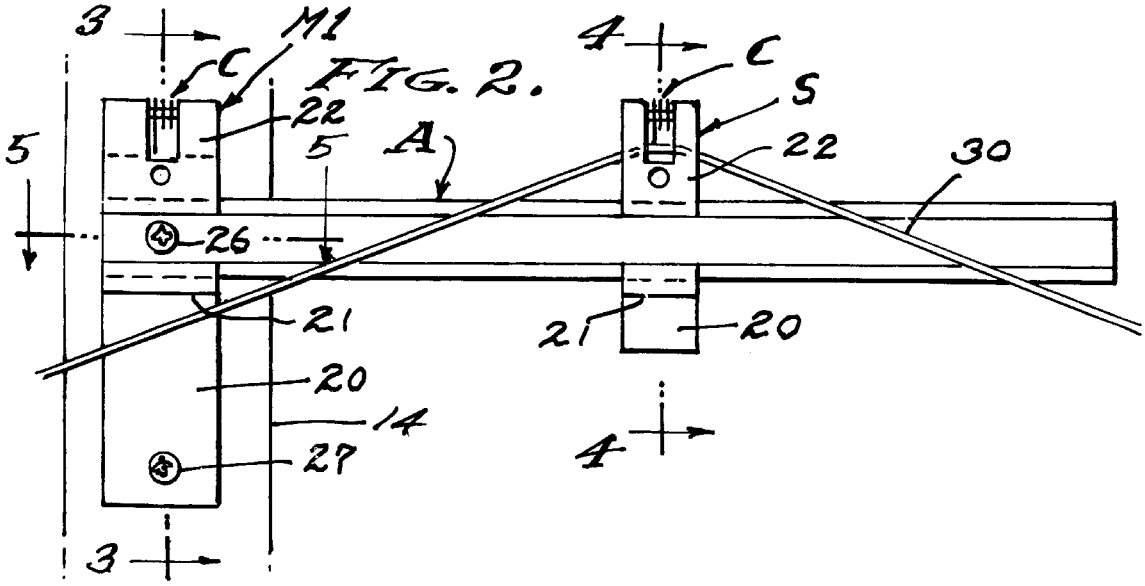
FIG. 2 is an enlarged view of the Hanger Bracket as appears removed from the construction of FIG. 1 and showing it's relationship to a stud and from which it cantilevers to carry the mirror.
Figure 3:
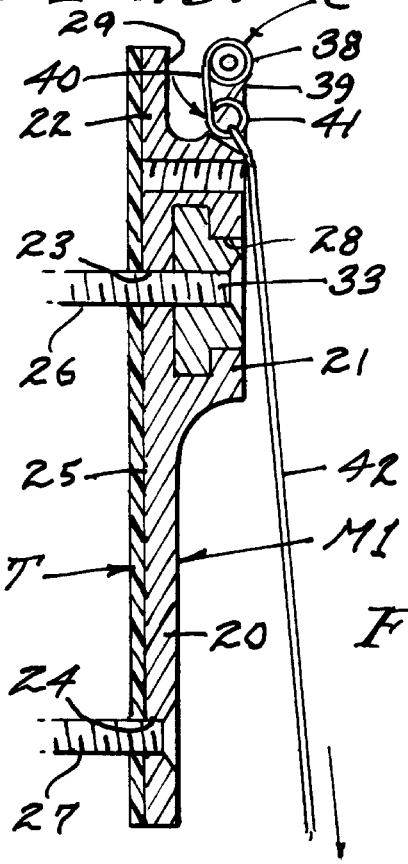
FIG. 3 is an enlarged sectional view of the Hanger Bracket taken as indicated by line 3—3 on FIG. 2.
Figure 5:
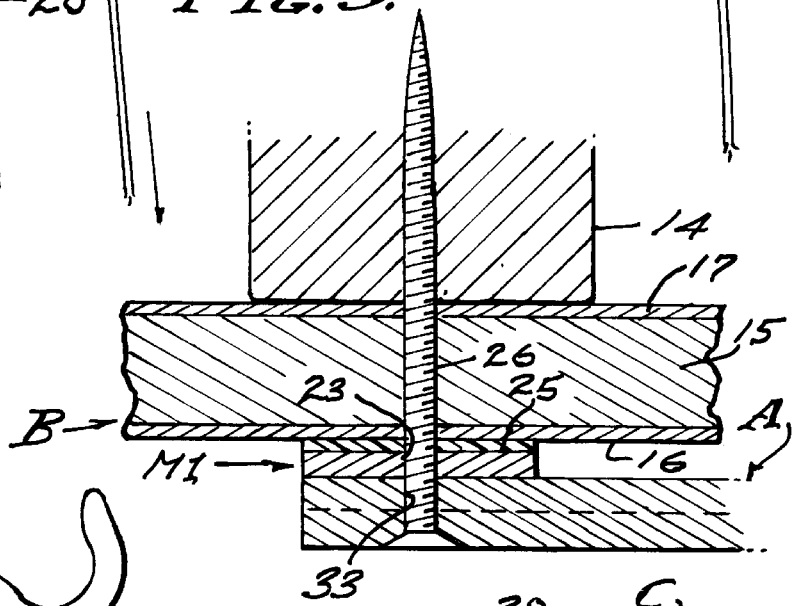
FIG. 5 is an enlarged plan sectional view illustrating the stud—dry-wall and Hanger Bracket relationship.

Referring now to FIG. 1 and a standardized dry-wall construction, there is a bottom plate 10 at the sub floor 11, and double plates 12 at the ceiling 13. Vertical 2×4 studs 14 spaced on 16 inch centers extend between the bottom and top plates. A usual 8 foot ceiling is shown, with the studs covered with a finished dry-wall, the joints of which are not indicated. For example, ⅝ inch thick wallboard B with a gypsum core 15 pressed between front and back layers of heavy paper 16 and 17 is shown (see FIG. 5). The wallboard B is nailed to the studs (not shown). Typically, the wallbaord B is unsupported between the studs 14, The hanger mounting M1 as shown in FIGS. 2, 3 and 5 is an elongated vertical member formed from a basic extrusion comprised of a flat verticaly disposed leg 20 and a horizontally disposed header 21 with an overlying hook 22. The overall height of the hanger mounting member M1 is approximately 4 inches with top and bottom fastener openings 23 and 24 spaced vertically approximately 3 inches apart. In practice, the leg 20, header 21 and hook 22 are integral and approximately 1 inch wide as shown in FIG. 2. The leg 20 is essentially continuous through the header 21 and hook 22, and it presents a flat side 25 to face against the planar surface of the wallbboard B. The front face of the leg 20 is also flat and the opening 24 is countersunk to receive a flat headed screw.

A feature is the double sided pressure sensitive tape T that is coextensively applied to the side 25 for placement of the hanger mounting M in an optimum position before applying the mounting fasteners 26 and 27. In other words, accurate placement of the hanger mounting M can be empirical, so that no mistake is made in its securement.

The header 21 of the hanger mounting M is a horizontally disposed "C" section that opens right and left so as to slideably receive a complementary cross section of the cantilever arm A. It is to be understood that the "C" section engagement can be reversed, to right or left end of the arm A being of "C" section that is slideably received through the opening at either side of the bracket 21. As shown in FIGS. 2 and 3, the "C" cross section of the header 21 opens forwardly at 28 to be occupied by a complementary configuration of the bar-shaped cantilever arm A. A feature is that the opening at 28 affords access to the top fastener opening 23, there being an aligned fastener opening 33 through the cantilever arm A, as later described.

The hook 22 of the hanger mounting M is also horizontally disposed and it presents an upwardly opening throat 29 to receive a picture hanging wire 30 or hook, or for a mirror M as shown or any other heavy object. The throat 29 is of substantial height so as to prevent accidental displacement of a wire or hook.

Referring now to the cantilever arm A, said arm is fixedly carried by the aforesaid hanger mounting M1 to be juxtaposed to and parallel with the planar surface of the wallboard B to selectively receive the hanger slide S from the left or right. Alternately, the hanger slide can be fixed to the cantilever arm A and the latter permitted to slide in the header 21. As best shown in FIG. 5, securement means affixes the fulcrum end of the cantilever arm A to the header 21 the fastener 26 passing through opening 33, thereby to simultaneously secure the members M1 and A and the assembly thereof to the underlying stud 14. A right handed extension of the cantilever arm A is shown. However, it is to be understood that a left handed extension thereof is equally facilitated, as the cantilever arm A cross section and that of the header 21 are symmetrical. Accordingy, the fastener opening 33 is countersunk to receive a flat headed screw to bear flat against any object (see FIG. 3).

Figure 4:
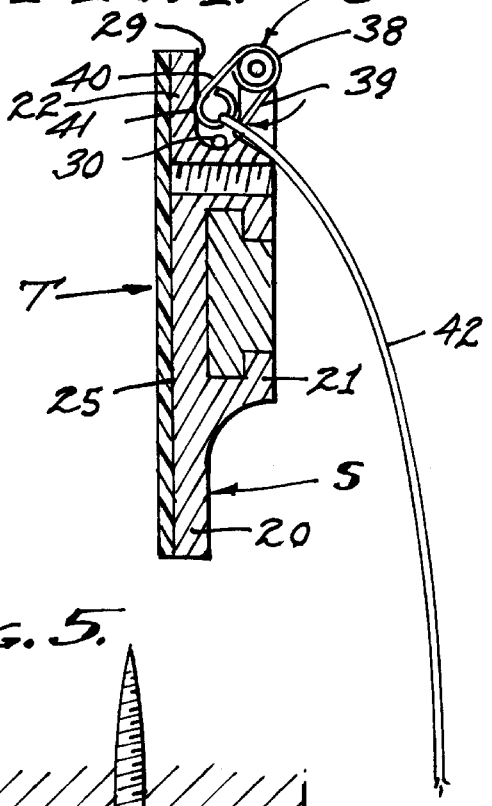
FIG. 4 is an enlarged sectional view of the Hanger Bracket taken as indicated by line 4—4 on FIG. 2.

Referring now to the hanger slide S, said slide is shiftably carried and captured in place along the cantilever arm A. The slide S is movable laterally on the cantilever arm A and is omni adjustable therealong. As shown in FIG. 4, the hanger slide S is formed from the same basic extrusion as that of the above described hanger mount M1 and has the identical leg 20, header 21 and hook 22 features. However, the hanger slide S is narrower than the width of the hanger mounting M1, and a substantial portion of the depending leg 20 is removed, as it is unnecessary in supporting the hook 22. Accordingly, the hanger slide S has a hanger means to receive a support wire 30 or hook to carry a heavy object. In practice, the hanger slide S is prevented from sliding off of the end of the cantilever arm A by upsetting its terminal end as by staking (not shown).

Figure 6:
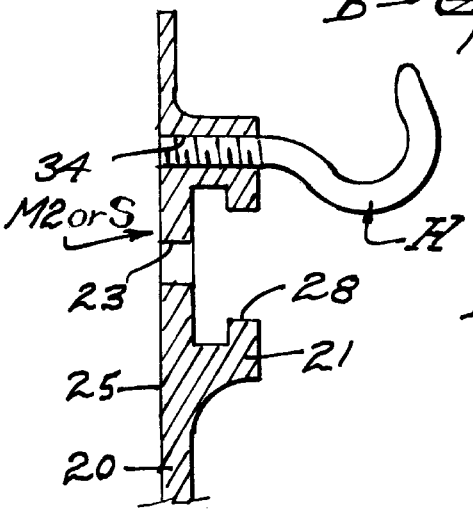
FIG. 6 is a view similar to FIGS. 3 and 4 and illustrates a modification to the basic extrusion which alternately forms the hanger mounting of FIG. 3 by the hanger slide of FIG. 4.

Referring now to FIG. 6 and to a modified forming of the basic extrusion, the leg 20 may or may not be shortened in order to form a slide S or a mount M1 or M2. When the wire 30 or hook load is to be carried by the slide S, then the hook features are removed from the hanger mount M1 (see FIG. 6). Or when the load is to be carried by a hook or the like, a forwardly projecting hook H is threaded into a tapped opening 34 at the joinder of the header 21 and hook features 22, the hook 22 feature being removed as they are unnecessary (see FIG. 6). It is to be understood that this hook H and removal of the hook 22 features can be applied to either the hanger mount or to the hanger slide.

A feature of this invention is the releasable catch C that prevents displacemnet of a suspension wire or hook. As shown in FIG. 4, a spring captures it in the throat 29 of the hook 22. In practice, the hook portion of the basic extrusion is bifurcated horizontally so that the throat opens upwardly and parallel to the wallboard B, forming front and back walls. The center section of the front wall is removed to receive a spring coil 38 having a depending anchor leg 39 bearing upon the inside of the front wall, and having a depending stop leg 40 biased by the coil against the opposite inside of the back wall (see FIG. 4). By depressing the stop leg 40 the throat 29 is opened (see FIG. 3). A feature is the access provided to depress the stop leg 40, comprised of a loop 41 at the terminal end of the stop leg 40 from which a lanyard 42 extends downwardly to be pulled manually as shown in FIG. 3, to open the throat 29.

A typical hanging of a mirror M is illustrated in FIG. 1, safely suspended over a piece of furniture F by the Hanger Bracket of the present invention. As shown, the nearest stud 14 to the center line of suspension is selected for installation of the hanger mounting M1, location of said stud being found by using a state of the art "stud Linder" and said hanger mounting temporarily adhered to the wallboard B by the pressure sensitive tape T. When the exact and desired placement is found,, then the screw fasteners 26 and 27 are applied, the top fastener 26 being applied through the openings 33 and 23 of the cantilever arm A and hanger mounting M1 respectively. It will be observed that the cantilever arm A extends beyond the center point between next adjacent studs 14, whether from left or right of the hanger mounting M1, and accordingly the hanger slide S is enabled to be positioned at least midway between the studs. However and as shown in FIG. 1, the positioning of the hanger slide is most likely to be less than half the distance between studs. And, like the hanger mounting M1, the hanger slide S position along the cantilever arm A is selected and it is adhered in place by the pressure sensitive tape T so as not to shift out of position when the object to be hung, the mirror M, is being suspended from the hook features of said slide, thereby cantilevering the load from a fulcrum at the fastener 26, and support established by a first class lever anchored at the fastener 27.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A bracket for hanging a heavy object against a dry-wall construction and including;

a hanger mounting comprised of a vertically disposed leg with means for fastening it against said dry-wall at one of two spaced studs between which the object is to be hung, and with a header having a horizontal opening, a cantilever arm fixedly carried by the horizontal opening in the header of the hanger mounting and juxtapositioned to and parallel with a front planar surface of the dry-wall and extending laterally from the hanger mounting to an intermediate position between said two spaced studs, and a hanger slide selectively positioned along the cantilever arm to a selected hanging position, and having means for hanging said object from said hanger slide, whereby the object is hung from a stud independent of the dry-wall extending between said two spaced studs.

2. The bracket for hanging a heavy object against a dry-wall, as set forth in claim 1, wherein the means for fastening includes vertically spaced fasteners secured into said one of the two spaced studs, fixedly positioning the hanger mounting.

3. The bracket for hanging a heavy object against a dry-wall, as set forth in claim 2, wherein the vertically disposed leg of the hanger mounting is flat with top and bottom fastener openings, and wherein the header horizontal opening is open right and left to alternately receive an end of the cantilever arm.

4. The bracket for hanging a heavy object against a dry-wall, as set forth in claim 2, wherein the header opening is of C-shaped cross section opening right and left therethrough for right or left positioned reception of a complementary end of the cantilever arm.

5. The bracket for hanging a heavy object against a dry-wall, as set forth in claim 1, wherein the means for fastening includes top and bottom vertically spaced fasteners secured into said one of the two spaced studs, and one of the fasteners being a fulcrum and the other an anchor of a first class lever and the hanger slide applying the load.

6. The bracket for hanging a heavy object against a dry-wall, as set forth in claim 1, wherein the means for fastening includes top and bottom fasteners and a bottom anchor fastener spaced below said top fulcrum fastener and both secured into said one of the studs, and the top fulcrum fastener being at the header from which the cantilever arm fixedly extends as the load carrying arm of a first class lever.

7. The bracket for hanging a heavy object against a dry-wall, as set forth in claim 4, wherein the vertically disposed leg of the hanger mounting is flat with top and bottom fastener openings, and the header opening is open right and left therethrough for right or left reception of an end of the cantilever arm for selective extension left or right as the load carrying arm of a first class lever.

8. The bracket for hanging a heavy object against a dry-wall, as set forth in claim 4, wherein the vertically disposed leg of the hanger mounting is with a flat side opposed to and to engage against said dry-wall and with top and bottom fastener openings, and the header opening is open right and left therethrough for right or left reception of an end of the cantilever arm for selective extension left or right as the load carrying arm of a first class lever.

9. The bracket for hanging a heavy object against a dry-wall as set forth in claim 1, wherein the means for fastening includes a top fulcrum fastener secured through aligned openings in the cantilever arm and hanger mounting and into said one of the studs, and a bottom anchor fastener spaced below said top fulcrum fastener and secured into said one of the studs and through the hanger mounting, thereby affixing the cantilever arm to the hanger mounting and juxtaposed to said dry-wall.

10. The bracket for hanging a heavy object against a dry-wall, as set forth in claim 5, wherein the vertically disposed leg of the hanger mounting is flat with top and bottom fastener openings, and the header opening is open right and left therethrough for right or left reception of an end of the cantilever arm for selective extension left or right as the load carrying arm of a first class lever.

11. The bracket for hanging a heavy object against a dry-wall, as set forth in claim 1, wherein the cantilever arm is horiztonally disposed for selective placement of the hanger slide therealong, and wherein the hanger slide is adjustably supported upon said arm.

12. The bracket for hanging a heavy object against a dry-wall, as set forth in claim 1, wherein the hanger slide carries an upwardly opening hook with a throat to receive a horizontally disposed support wire from the object to be hung, the means for hanging said object from the hanger slide being a releasable catch comprised of a spring coil having a retractile stop leg biased thereby to close the throat of the hook for capture of the support wire and depressible to open the throat of the hook to release said wire.

13. The bracket for hanging a heavy object against a dry-wall, as set forth in claim 1, wherein the hanger slide carries an upwardly opening hook with a throat to receive a horizontally disposed support wire from the object to be hung, the means for hanging said object from the hanger slide being a releasable catch comprised of a spring coil having a retractile stop leg biased thereby to close the throat of the hook for capture of the support wire and depressible by tension applied to a lanyard attached to a loop at the terminal end of the stop leg to open the throat of the hook for release of said wire.

14. The bracket for hanging a heavy object against a dry-wall, as set forth in claim 1, wherein the means for fastening includes a top fulcrum fastener and a bottom anchor fastener spaced below said top fulcrum fastener and both secured into said one of the studs, and wherein the hanger mounting header is at the top fulcrum fastener from which the cantilever arm fixedly extends as a load carrying arm of a first class lever, there being a hook carried by and over the header to receive an object support wire and there being a threaded opening at the joinder of the header and overlying hook for receiving a forwardly projecting hook.

* * * * *